US012089737B2

(12) United States Patent
Netzer

(10) Patent No.: US 12,089,737 B2
(45) Date of Patent: Sep. 17, 2024

(54) PULL-OUT GUIDE FOR A DRAWER

(71) Applicant: Julius Blum GmbH, Hoechst (AT)

(72) Inventor: Emanuel Netzer, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 17/706,001

(22) Filed: Mar. 28, 2022

(65) Prior Publication Data

US 2022/0218106 A1 Jul. 14, 2022

Related U.S. Application Data

(63) Continuation of application No. PCT/AT2020/060364, filed on Oct. 12, 2020.

(30) Foreign Application Priority Data

Oct. 21, 2019 (AT) ..... A 50903/2019

(51) Int. Cl.
*A47B 88/45* (2017.01)
*A47B 88/477* (2017.01)

(52) U.S. Cl.
CPC ..... *A47B 88/45* (2017.01); *A47B 88/477* (2017.01); *A47B 2210/092* (2013.01)

(58) Field of Classification Search
CPC .. A47B 88/45; A47B 88/477; A47B 2210/092
USPC ..... 312/331
See application file for complete search history.

(56) References Cited

U.S. PATENT DOCUMENTS

| | | | |
|---|---|---|---|
| 8,220,882 | B2 | 7/2012 | Kropf et al. |
| 8,534,781 | B2 | 9/2013 | Netzer et al. |
| 8,668,286 | B2 | 3/2014 | Gasser |
| 8,833,879 | B2 | 9/2014 | Netzer |
| 9,642,461 | B2 | 5/2017 | Goetz et al. |
| 9,717,334 | B2 | 8/2017 | Goetz et al. |
| 10,405,653 | B2 | 9/2019 | Goetz et al. |
| 10,750,861 | B2 | 8/2020 | Wohlgenannt |
| 10,959,519 | B2 | 3/2021 | Kloth et al. |
| 2008/0036345 | A1 | 2/2008 | Kropf et al. |

(Continued)

FOREIGN PATENT DOCUMENTS

| | | |
|---|---|---|
| CN | 103960890 | 8/2014 |
| CN | 105228490 | 1/2016 |

(Continued)

OTHER PUBLICATIONS

International Search Report issued Dec. 15, 2020 in International (PCT) Application No. PCT/AT2020/060364.

*Primary Examiner* — James O Hansen
(74) *Attorney, Agent, or Firm* — WENDEROTH, LIND & PONACK, L.L.P.

(57) ABSTRACT

A pull-out guide for a drawer includes a carcass rail configured to be arranged on a side of a furniture carcass, and a drawer rail configured to be arranged on a drawer. The drawer rail is displaceably supported on the carcass rail in an opening- and closing direction, and the drawer rail has an upper side facing towards the drawer and a lower side spaced from the upper side by at least one side limb. A bearing device is provided for a synchronization rod of a synchronization device. The bearing device includes a fastening region for the synchronization rod, and the fastening region is arranged below the underside of the drawer rail.

22 Claims, 8 Drawing Sheets

(56) References Cited

U.S. PATENT DOCUMENTS

| | | | | |
|---|---|---|---|---|
| 2012/0038255 | A1 | 2/2012 | Netzer et al. | |
| 2012/0091872 | A1 | 4/2012 | Matthes et al. | |
| 2012/0237144 | A1 | 9/2012 | Gasser | |
| 2013/0249368 | A1 | 9/2013 | Netzer | |
| 2013/0307390 | A1* | 11/2013 | Bohle | F16C 3/02 312/294 |
| 2013/0328468 | A1 | 12/2013 | Schneider et al. | |
| 2013/0334946 | A1 | 12/2013 | Netzer et al. | |
| 2014/0265783 | A1* | 9/2014 | Hauer | A47B 88/493 312/331 |
| 2015/0374125 | A1 | 12/2015 | Goetz et al. | |
| 2016/0007750 | A1 | 1/2016 | Goetz et al. | |
| 2018/0020833 | A1 | 1/2018 | Goetz et al. | |
| 2018/0160808 | A1 | 6/2018 | Wohlgenannt | |
| 2019/0223594 | A1 | 7/2019 | Kloth et al. | |
| 2020/0375358 | A1* | 12/2020 | Chen | A47B 88/463 |

FOREIGN PATENT DOCUMENTS

| | | |
|---|---|---|
| CN | 105433618 | 3/2016 |
| CN | 109414113 | 3/2019 |
| CN | 109890251 | 6/2019 |
| DE | 20 2006 012 347 | 1/2008 |
| DE | 20 2009 016 105 | 1/2011 |
| EP | 2 636 340 | 12/2014 |
| EP | 2 644 052 | 5/2015 |
| EP | 3 282 895 | 6/2019 |
| JP | 2012-526565 | 11/2012 |
| WO | 2010/129971 | 11/2010 |
| WO | 2011/075752 | 6/2011 |
| WO | 2012/068605 | 5/2012 |
| WO | 2014/165874 | 10/2014 |
| WO | 2017/004638 | 1/2017 |

* cited by examiner

PULL-OUT GUIDE FOR A DRAWER

BACKGROUND OF THE INVENTION

The present invention relates to a pull-out guide for a drawer, comprising a carcass rail configured to be arranged on a side of a furniture carcass, and a drawer rail configured to be arranged on a drawer, the drawer rail being displaceably supported on the carcass rail in an opening- and closing direction. The drawer rail has an upper side facing towards the drawer and a lower side spaced from the upper side by at least one side limb. The pull-out guide further comprises a bearing device for a synchronization rod of a synchronization device, the bearing device including a fastening region for the synchronization rod. Moreover, the invention concerns an arrangement comprising two such pull-out guides, and an item of furniture comprising a drawer and an arrangement of the mentioned type.

In order to move movable furniture parts, in particular drawers, relative to a furniture carcass, the movable furniture parts are usually movably supported in an opening- and closing direction via pull-out guides, the pull-out guides comprising a carcass rail and a drawer rail. With such furniture fittings, synchronization devices are frequently provided so as to allow a smooth opening and closing on both sides, and helping to prevent an inclination, and, therewith, a jamming of the drawer.

An example for such a furniture fitting is disclosed in EP 3 282 895 B1. A drawback with this furniture fitting is the fact that the drive devices in the form of ejection devices arranged on both sides are relatively broad and take up much space.

SUMMARY OF THE INVENTION

Therefore, the object of the present invention is to provide an alternative or an improved arrangement, respectively, with respect to the prior art. In particular, the space requirement shall be as small as possible.

This is accomplished by a pull-out guide in which the fastening region (preferably extending horizontally in the installation position), is arranged below the underside of the drawer rail.

Therefore, it is possible for the synchronization rod to span the drawer rail. This, in turn, results in that possibly provided drive devices can be arranged between the drawer rail and the furniture carcass.

The terms "horizontal", "vertical", "upper side" and "underside" always refer to the installed condition of the pull-out guide and of the furniture fitting, respectively, in the furniture carcass.

According to a preferred embodiment, the fastening region is arranged between the drawer rail and the carcass rail. Therefore, a possibly provided drive device can be arranged between these two rails, for which reason the entire unit can be configured very narrow. This means that the maximum width, measured in a horizontal direction and perpendicular to the opening direction, of the pull-out guide including the carcass rail, the drawer rail, the bearing device and a possibly provided drive device is less than 100 mm, preferably less than 75 mm. It can be particularly preferred that this width lies in a region between 40 mm and 70 mm.

In order to provide a transmission of movement from the synchronization rod to further components, the fastening region can be that region in which the synchronization rod contacts the bearing device.

The bearing device has to be configured such that the synchronization rod can be supported thereon and can be fixed in the fastening region. Preferably, the bearing device includes a carrier arranged on the carcass rail or on the drawer rail, and a receiving portion for the synchronization rod, the receiving portion being movably, preferably pivotally, supported on the carrier.

When the receiving portion is pivotally supported, preferably the rotational axis extends in a horizontal direction and perpendicular to the opening direction of the drawer.

The synchronization rod can be configured to be connected to the bearing device, for example, via a snap-connection device. Likewise, also other releasable connection variants are possible. In fact, it is possible that the fastening region is configured in the form of a protrusion on which the synchronization rod can be fixed. However, it is particularly preferred that the fastening region is configured as a recess in the receiving portion.

Protection is also sought for an arrangement comprising two pull-out guides according to the invention, the pull-out guides being configured to be mounted to opposing sides of a furniture carcass.

It is particularly preferred that this arrangement, besides the two pull-out guides, also includes a synchronization device including a synchronization rod for synchronizing movements of the drawer rail or of movements of possibly provided drive devices.

Further, it is preferable that the synchronization rod has two ends, and is supported via their ends in the fastening regions of the bearing devices, the synchronization rod extending below the drawer rails. This means that the synchronization rod does not extend between the drawer rails or above the drawer rails, but rather entirely below these drawer rails. Thereby, it can be particularly preferred that the synchronization rod is aligned horizontally in the installed condition and entirely extends vertically below the drawer rails in the installed position.

It is particularly preferred that the arrangement also includes at least one drive device for the drawer, the at least one drive device being preferably mounted to one of the carcass rails. Preferably, the arrangement includes two drive devices (each mounted to one of the carcass rails) for the drawer.

It is possible that at least one drive device is configured as a retraction device configured to retract the drawer from an open position into the closed position. However, according to a preferred embodiment, the at least one drive device is configured as an ejection device for ejecting the drawer. The ejection device is configured to be unlocked by applying pressure to the drawer when located in the closed position, and the drawer can be moved from the closed position in the opening direction and can be brought into an open position by the unlocked ejection device.

According to a specific embodiment, it is preferable that the at least one drive device configured as an ejection device includes a housing, an ejection slider movably supported in the housing, an ejection energy storage member fixed to the housing and to the ejection slider, a heart-shaped guide track formed in the housing, a locking pin configured to be locked in a locking recess of the guide track, and a control lever movably supported on the ejection slider, the control lever having the locking pin.

For the sake of a simple and space-saving construction, it is preferable that the housing forms the carrier of the bearing device. Accordingly, the receiving portion of the bearing device is movably supported directly in the housing.

For a simple transmission of movement between the synchronization rod and the drive device, it is preferable that a coupling element is formed or arranged on the receiving portion. The coupling element is preferably gear-shaped and is configured to be coupled in a movement-transmitting manner to a coupling element, preferably shaped as a toothed rack. It is particularly preferred that the coupling element is arranged or formed on a synchronization slider movably supported, preferably linearly, on the housing.

The precise alignment and position of the synchronization rod is, in fact, arbitrary, as long as a synchronized transmission of movement between both sides of the pull-out guide can be provided. It is preferable that the synchronization rod (in an installed condition) is aligned horizontally and perpendicularly to the opening- and closing direction.

Protection is also sought for an item of furniture comprising a furniture carcass, at least one drawer (movable in the opening direction), and an arrangement of the described type.

BRIEF DESCRIPTION OF THE DRAWINGS

Further details and advantages of the present invention will be described in more detail in the following with the aid of the description of figures and with reference to the embodiments shown in the drawings, in which.

DETAILED DESCRIPTION OF THE INVENTION

Figure 1:
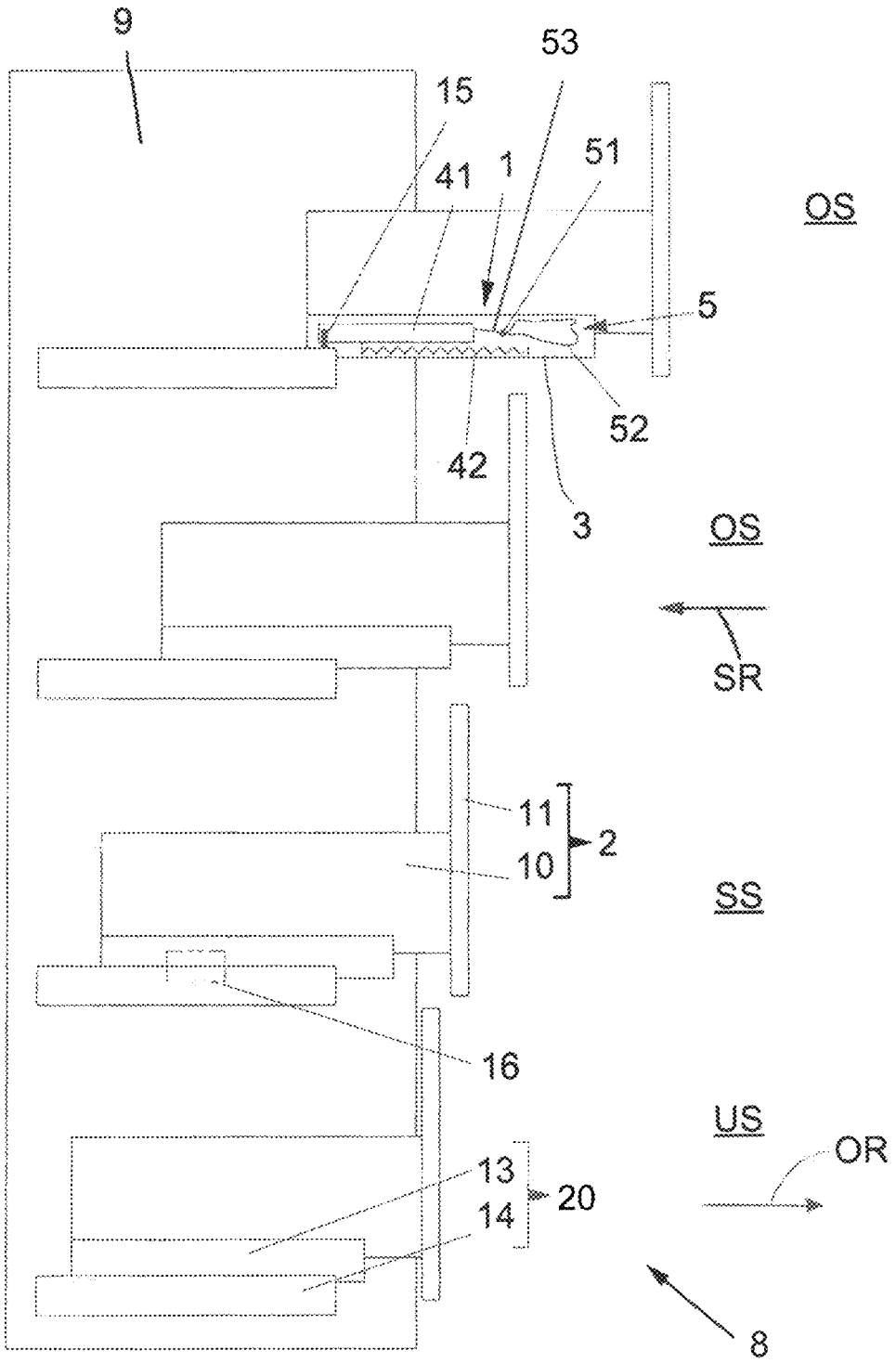
FIG. 1 shows an item of furniture comprising a plurality of movable furniture parts in the form of drawers.

FIG. 1 shows, very generally, an item of furniture 8 comprising a furniture carcass 9 and, in total, four movable furniture parts in the form of drawers 2. Each of the drawers 2 consists of at least a sliding container 10 and a front panel 11. The drawers 2 are fixed to the furniture carcass 9 via a (drawer) pull-out guide 20 comprising a drawer rail 13 and a carcass rail 14 (and possibly a central rail, not shown).

With the uppermost drawer 2, a drive device 1 is schematically depicted. The drive device 1 includes a housing 3. In this case, this housing 3 is arranged on the drawer rail 13 (in the schematic illustration according to FIG. 1, the housing 3 corresponds to the drawer rail 13). The drive device 1 includes an ejection device 4, and the ejection slider 41 and the ejection energy storage member 42 of this ejection device 4 are schematically depicted. The locking device 5 includes a guide track 52 formed in the housing 3, and the locking pin 51 guided in the guide track 52 (the guide track 52 being, in this case, heart-shaped). An entrainment member 15 is arranged on the carcass rail 14 (or on the furniture carcass 9 itself), the ejection device 4 being at least over a region in engagement with the entrainment member 15. However, the arrangement may also be reversed. This means that the drive device 1 is associated to the carcass rail 14, whereas the entrainment member 15 is associated to the movable furniture part. The uppermost drawer 2 is located in the open position OS.

When the drawer 2 is moved from the open position OS in the closing direction SR, the locking pin 51 is displaced in a closing section of the guide track 52. Thereby, the ejection storage member 42 can be tensioned by a relative movement between the ejection slider 41 and the housing 3.

In the closed position SS (third drawer 2 from above), the ejection energy storage member 42 is fully tensioned. This closed position SS can be achieved by an exclusive manual closing movement. Alternatively, the drawer 2 can be moved or retracted into the closed position SS by the schematically depicted retraction device 16. The retraction device 16, if present, is integrated into the pull-out guide 20.

Starting from that closed position SS, the drawer 2 reaches an overpressing position US (lowest drawer 2 in FIG. 1) by applying pressure to the drawer 2. As a result, unlocking of the locking device 5 can be achieved. After the overpressing in the closing direction SR has been performed, as soon as the operator no longer applies a pressure to the drawer 2, the drawer 2 is ejected by the drive device 1 in the opening direction OR. Therefore, the drawer 2 reaches the open position OS according to the second drawer 2 from above. In this position, the drawer 2 can be gripped, for example via the front panel 11, and can be further moved manually into the position according to the first drawer 2 from above.

Figure 2:
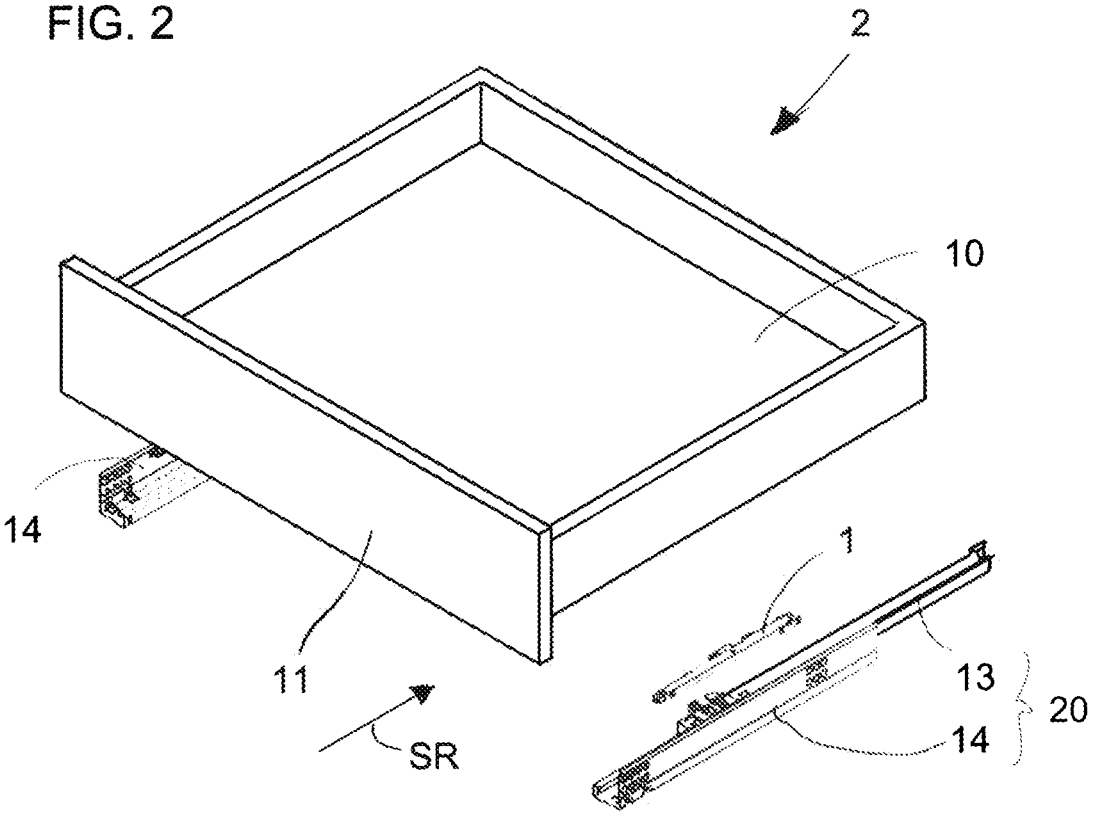
FIG. 2 is a perspective view of a drawer with drawer pull-out guides and drive devices for a movable furniture part.

FIG. 2 shows a perspective view of a drawer 2 with the sliding container 10 and a front panel 11. Moreover, an arrangement comprising two pull-out guides 20 with each two drawer rails 13 and two carcass rails 14 is shown, and each of a drawer rail 13 and a carcass rail 14 of the pull-out guide 20 is provided on both sides of the drawer 2. FIG. 2 further shows a drive device 1. The drive device 1 is arranged on the carcass rail 14. This drive device 1 (or its housing 3, respectively) extends in the closing direction SR of the drawer 2. In particular with smaller or narrower drawers 2, it can be sufficient when only one drive device 1 is associated to the drawer 2. The drive device 1 can be associated, as shown, to the right-sided pull-put guide 20 (but also to the left-sided pull-out guide 20).

Figure 3:
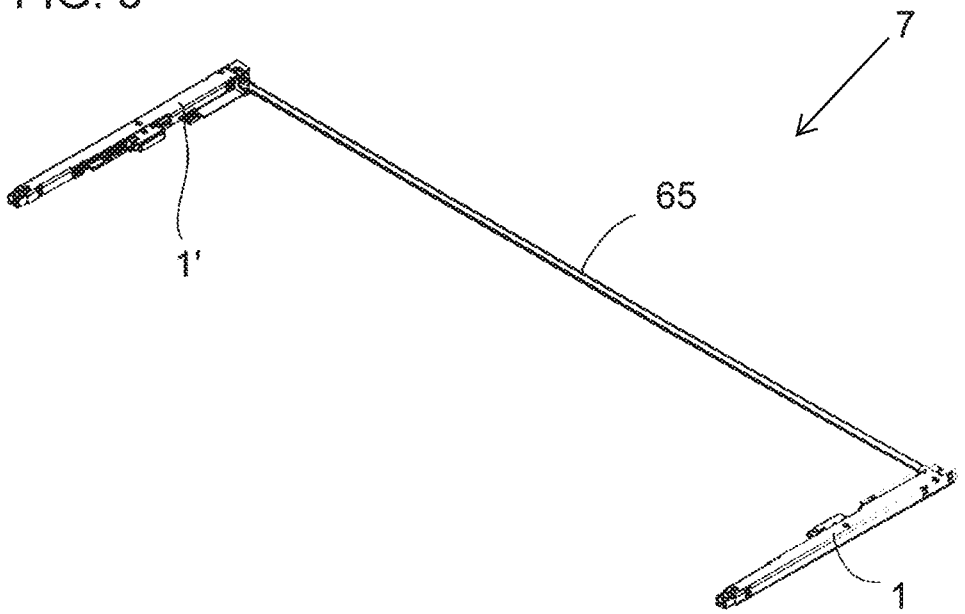
FIG. 3 shows an arrangement comprising two drive devices synchronized by a synchronization rod.

With broader or larger drawers 2, respectively, it can be advantageous, in particular for preventing inclined positions or jamming of the drawer 2 within the furniture carcass 9, when drive devices 1, 1' are provided on both sides of the drawer 2, the drive devices 1 and 1' being synchronized with one another. In FIG. 3, suitable thereto, an arrangement 7 comprising a (first) drive device 1 and a second drive device 1' is shown. These two drive devices 1 and 1' are connected to one another via a synchronization rod 65 (this arrangement 7 forms part of a superordinate arrangement comprising two pull-out guides 20 and as well as the arrangement 7). More specifically, sections of the opening movement and of the closing movement of the drive devices 1 and 1' are synchronized with one another. The first drive device 1 is configured to be mirror-symmetrical to the second drive device 1'. Besides, the drive devices 1 and 1' are configured so as to be identical.

Figure 4:
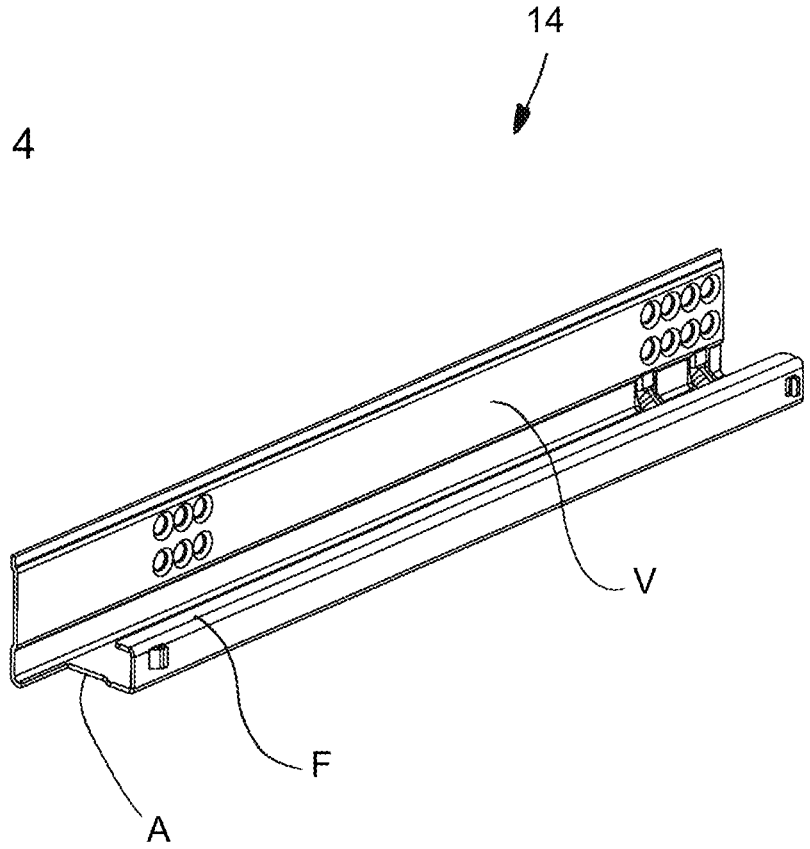
FIG. 4 shows a carcass rail in a perspective view.

FIG. 4 shows, in a perspective view, a profiled-shaped carcass rail 14. The carcass rail 14 can be mounted to a sidewall of a furniture carcass 9 via the vertical side limb V. The carcass rail 14 includes a guiding section F on which a drawer rail 13 (for example via corresponding rollers) is movably supported and guided. In one end region, the carcass rail 14 includes a recess A. In a region of this recess A, a bearing device 17 is connectable with the carcass rail 14. In the installed condition, this recess A is located on a side of the carcass rail 14 facing away from the front panel 11.

Figure 5:
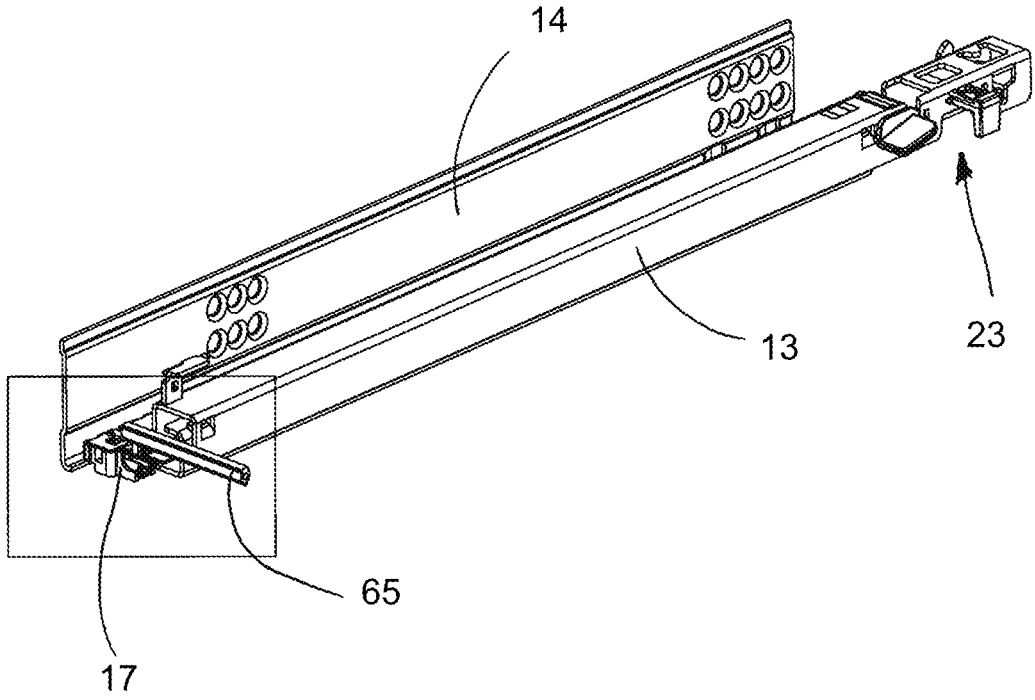
FIG. 5 is a perspective view of pull-out guide with the bearing device and the synchronization rod not yet arranged.

FIG. 5 shows a perspective view of the carcass rail 14, together with the drawer rail 13 movably supported thereon. In one end region, the drawer rail 13 includes a connecting device 23 for releasably connecting a drawer 2 to the drawer rail 13. In the other end region, it can be seen that a bearing device 17 is arranged on the carcass rail 14. A synchronization device 65 is also shown. However, the synchronization device 65 is not yet connected and not yet in contact with the bearing device 17.

Figure 6:
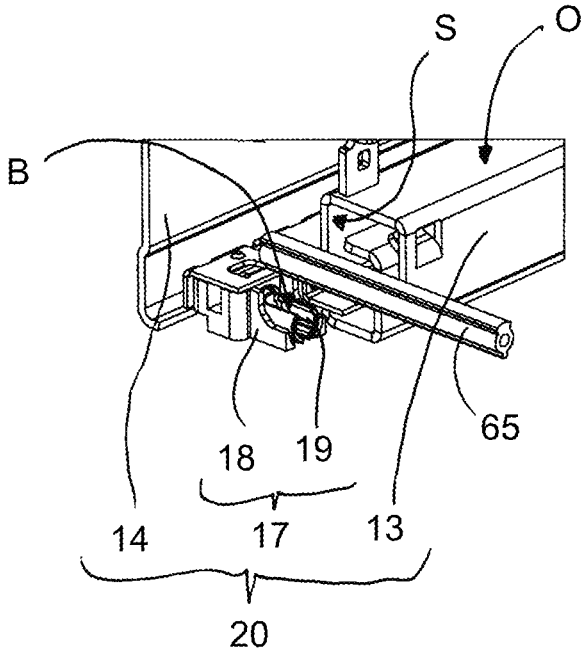
FIG. 6 is a detail of FIG. 5.

In FIG. 6, a detail of FIG. 5 is shown. For example, the (horizontally aligned) upper side O and the (vertically aligned) side limb S of the drawer rail 13 can be seen. Further, the carrier 18 and the receiving portion 19 collectively forming the bearing device 17 are depicted. The drawer rail 13, the carcass rail 14 and the bearing device 17 collectively form a pull-out guide 20. A recess is formed in the receiving portion 19. The surface of that recess forms the fastening region B contacting the synchronization rod 65 when the synchronization rod 65 is attached. The fastening region B is located between the drawer rail 13 and the carcass rail 14.

Figure 7:
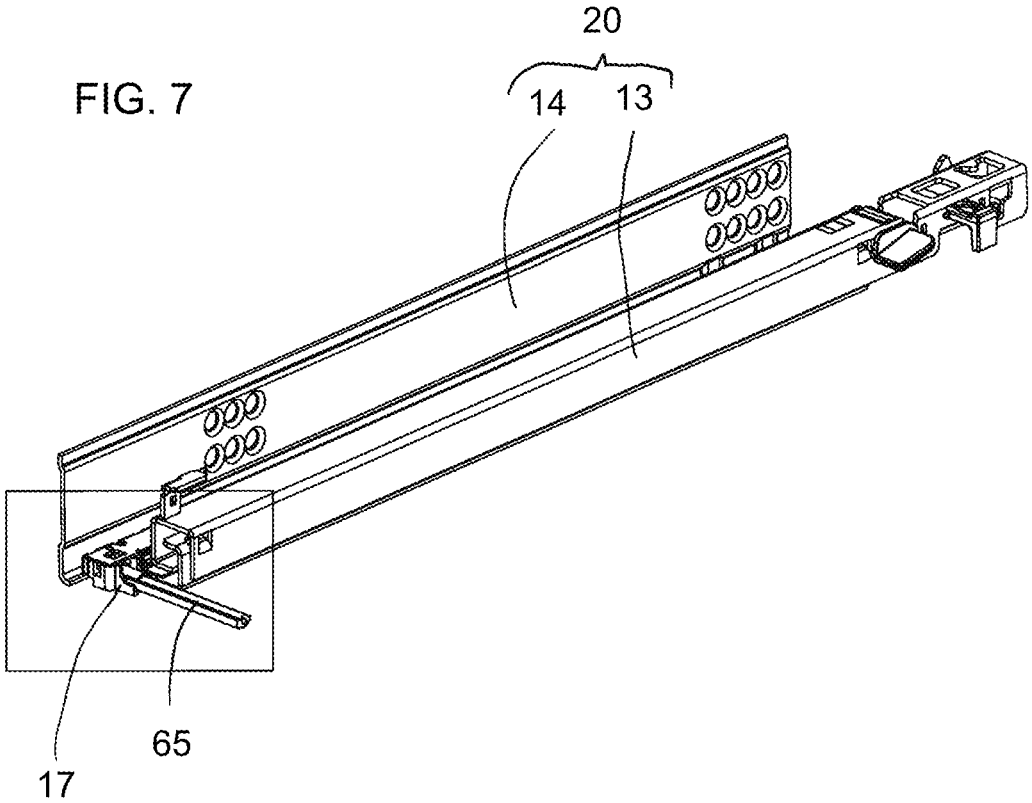
FIG. 7 shows a pull-out guide with the bearing device and the synchronization rod attached.

In FIG. 7, the synchronization rod 65 is depicted in a position attached on the bearing device 17. More specifically, a form-locking support between the synchronization rod 65 and the receiving portion 19 is provided.

Figure 8:
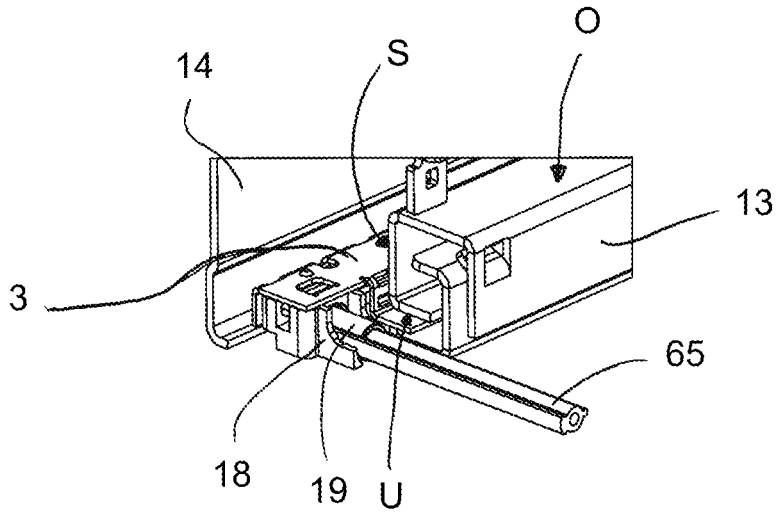
FIG. 8 is a detail of FIG. 7.

In FIG. 8, a detail of FIG. 7 is shown. Besides the upper side O and the side limb S, the (horizontally aligned) underside U of the drawer rail 13 can be seen. The side limb S connects the upper side O to the underside U. The synchronization rod 65 contacts the fastening region B of the receiving portion 19 of the bearing device 17. The fastening region B is arranged (in the installation position horizontally) below the underside U of the drawer rail 13. Therefore, the synchronization rod 65 (entirely) extends below the drawer rail 13. The carrier 18 of the bearing device 17 is part of a housing 3 of a drive device 1, 1'.

Figure 9:
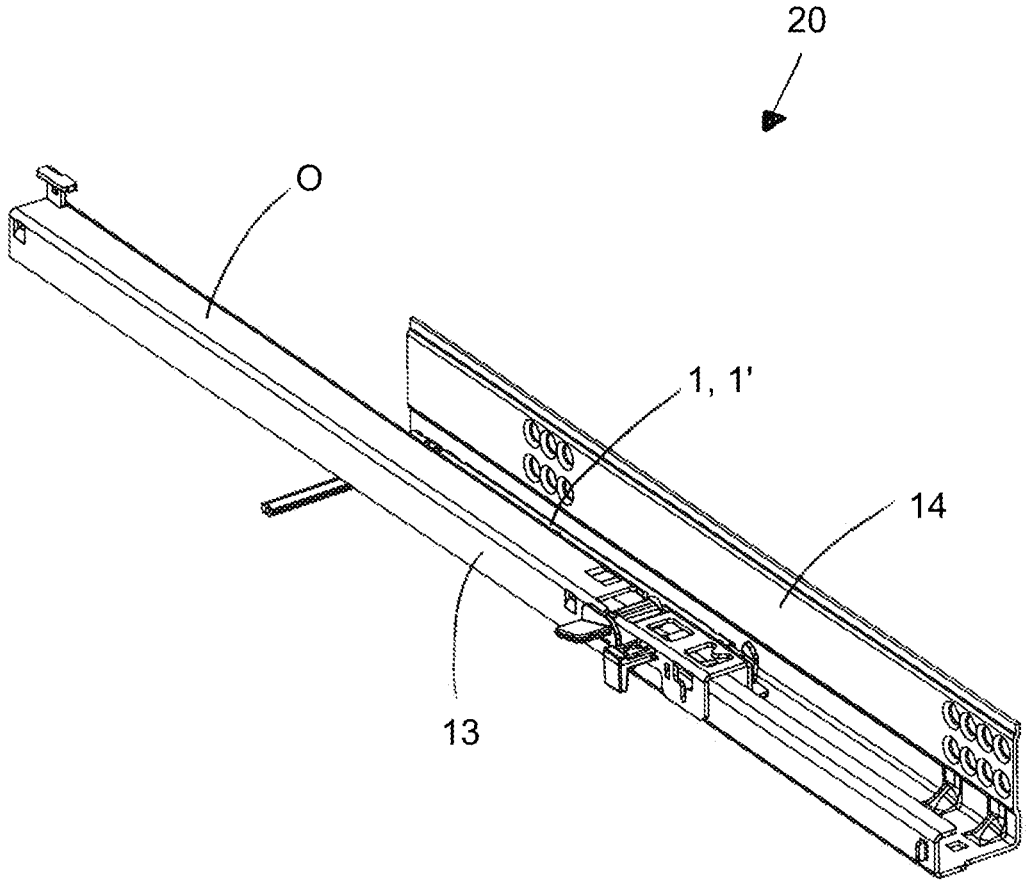
FIG. 9 shows the pull-out guide in a different perspective view.

FIG. 9 shows a perspective view of pull-out guide 20 seen from a different viewpoint. In addition to the two rails 13, 14 and the synchronization rod 65, a drive device 1, 1' can also be partially seen. This drive device 1, 1' is arranged between the drawer rail 13 and the carcass rail 14.

Figure 10:
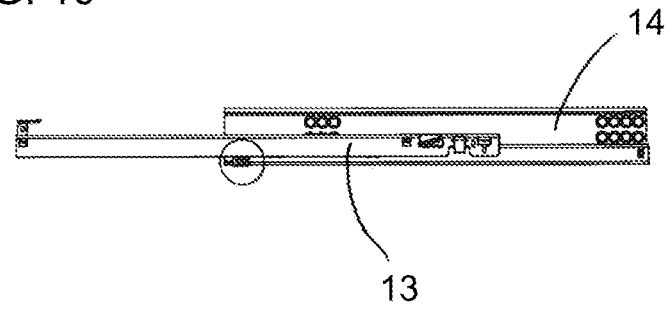
FIG. 10 is a side view of the pull-out guide.

FIG. 10 shows a side view of the pull-out guide 20 according to FIG. 9.

Figure 11:
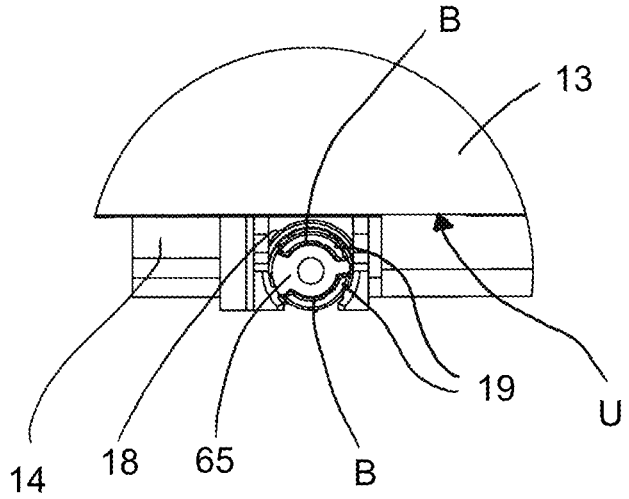
FIG. 11 is a detail of FIG. 10.

FIG. 11 shows a detail of FIG. 10 illustrating the region of the bearing device 17. The synchronization rod 65, shown in a cross-sectional view, is held in the fastening region B of the receiving portion 19 of the bearing device 17. Outer surfaces of the synchronization rod 65 contact the fastening region B. The carrier 18 forms part of the housing 3. In FIG. 11, the carcass rail 14 and the drawer rail 13 can be further seen. It is essential that the fastening region B (just as the synchronization rod 65) is arranged below the underside U of the drawer rail 13. As a result, the synchronization rod 65 extends below the drawer rail 13 and "spans" the drawer rail 13. Therefore, the drive device 1, 1' can be arranged between the carcass rail 14 and the drawer rail 13, resulting in a small space requirement. This means that it is not necessary for the drive device 1, 1' to be arranged on a side of the drawer rail 13 facing away from the carcass rail 14. This would lead to an overall broader construction.

Figure 12:
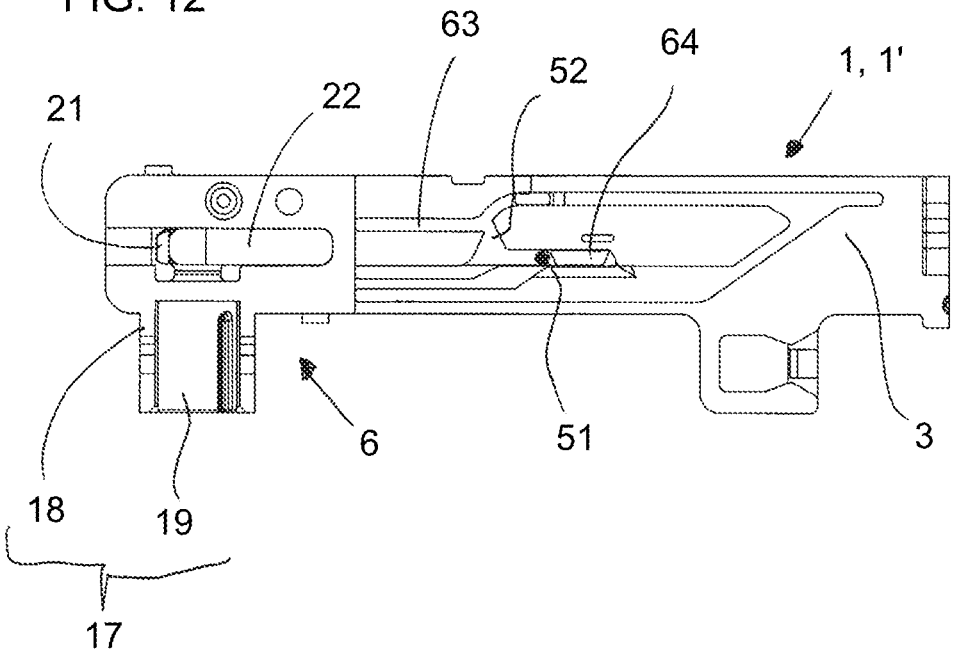
FIG. 12 is a top view onto a drive device with the bearing device.

FIG. 12 shows a top view onto a part of the drive device 1, 1' with the bearing device 17, a first gear-shaped coupling element 21, and a second tooth rack-shaped coupling element 22. More specifically, the heart-shaped guide track 52 is shown, the guide track 52 being arranged in the housing 3. The locking pin 51 is located in a position after overpressing and unlocking has been performed, and the ejection movement takes place upon unlocking. The locking pin 51 contacts the entrainment element 64 of the synchronization slider 63. Therefore, the region of the synchronization slider 63, on which the second toothed rack-shaped coupling element 22 is arranged, is also moved. In the illustration according to FIG. 12, the individual teeth of the second tooth rack-shaped coupling element 22 cannot be seen, because the teeth protrude from the drawing plane in a downward direction. On the contrary, at least one tooth of the first gear-shaped coupling element 21 can be seen. By a linear movement of the second coupling element 22, the teeth mesh with one another, thereby rotating the first gear-shaped coupling element 21. Due to the fact that the first gear-shaped coupling element 21 is connected to the receiving portion 19, the receiving portion 19 pivots relative to the carrier 18 of the bearing device 17 accordingly. In the shown embodiment, the carrier 18 and the housing 3 of the drive device 1, 1' are formed together so as to have an integral one-piece configuration. The synchronization slider 63 (with the entrainment element 64), jointly with the two coupling elements 21, 22 and the synchronization rod 65 (not shown here), collectively form the synchronization device 6. In this case, the synchronization device 6 serves for synchronizing the drive devices 1, l' arranged on both sides of a drawer 2.

However, it is also equally possible that the synchronization device 6 only serves for synchronizing the movement of the two drawer rails 13. This corresponds to a so-called side-stabilization.

LIST OF REFERENCES

1 drive device
2 drawer
3 housing
4 drive device
41 ejection slider
42 ejection storage member
5 locking device
51 locking pin
52 guide track
53 control lever
6 synchronization device
63 synchronization slider
64 entrainment element
65 synchronization rod
7 arrangement
8 item of furniture
9 furniture carcass
10 sliding container
11 front panel
13 drawer rail
14 carcass rail
15 entrainment member
16 retraction device
17 bearing device
18 carrier
19 receiving portion
20 pull-out guide

21 coupling element
22 coupling element
23 connecting device
OS open position
SS closed position
US overpressing position
SR closing direction
OR opening direction
O upper side
S side limb
U underside
B fastening region
V vertical side limb
A recess

The invention claimed is:

1. A pull-out guide for a drawer, comprising:

a carcass rail configured to be arranged on a side of a furniture carcass, the carcass rail having a vertical side limb to mount the carcass rail to the side of the furniture carcass, a drawer rail configured to be arranged on a drawer, the drawer rail being displaceably supported on the carcass rail in an opening- and closing direction, the drawer rail having an upper side facing towards the drawer and a lower side spaced from the upper side by a side limb, and a bearing device for supporting a synchronization rod of a synchronization device, the bearing device including a fastening region for receiving the synchronization rod, wherein the fastening region is arranged below the underside of the drawer rail and between the drawer rail and the vertical side limb of the carcass rail in a horizontal direction.

2. The pull-out guide according to claim 1, wherein the fastening region is a region in which the synchronization rod is to contact the bearing device.

3. The pull-out guide according to claim 1, wherein the bearing device includes a carrier arranged on the carcass rail or on the drawer rail, and a receiving portion for receiving the synchronization rod, the receiving portion being movably arranged on the carrier.

4. The pull-out guide according to claim 3, wherein the fastening region is configured as a recess in the receiving portion.

5. The pull-out guide according to claim 3, wherein the receiving portion is pivotally arranged on the carrier.

6. An arrangement comprising at least two pull-out guides each being configured according to claim 1, the at least two pull-out guides being further configured to be mounted to opposing sides of a furniture carcass.

7. The arrangement according to claim 6, further comprising a synchronization device for synchronizing movements of the drawer rails of the at least two pull-out guides or for synchronizing movements of drive devices, the synchronization device including a synchronization rod.

8. The arrangement according to claim 7, wherein the synchronization rod has two ends, and is supported via the two ends in the fastening regions of the bearing devices of the at least two pull-out guides, the synchronization rod extending below the drawer rails.

9. The arrangement according to claim 8, wherein the synchronization rod, in an installed condition, is aligned horizontally and extends vertically below the drawer rails.

10. The arrangement according to claim 7, further comprising a drive device for driving the drawer.

11. The arrangement according to claim 10, wherein the drive device is configured as an ejection device for ejecting the drawer, the ejection device being configured to be unlocked by applying pressure to the drawer located in the closed position, and the ejection device being configured to move the drawer from the closed position in the opening direction and into an open position when the ejection device is unlocked.

12. The arrangement according to claim 11, wherein the ejection device has a housing, an ejection slider movably supported in the housing, an ejection energy storage member fixed to the housing and to the ejection slider, a heart-shaped guide track formed in the housing, a locking pin configured to be locked in a locking recess of the guide track, and a control lever movably supported on the ejection slider, the control lever having the locking pin.

13. The arrangement according to claim 12, wherein the housing forms the carrier of the bearing device.

14. The arrangement according to claim 12, wherein a first coupling element is formed or arranged on the receiving portion, the first coupling element being configured to be coupled to a second coupling element in a movement-transmitting manner, wherein the second coupling element is formed or arranged on a synchronization slider movably supported on the housing.

15. The arrangement according to claim 14, wherein the first coupling element is gear-shaped, the second coupling element is tooth racked-shaped, and the synchronization slider is supported on the housing so as to move linearly.

16. The arrangement according to claim 10, wherein the drive device is mounted to a carcass rail of a first one of the at least two pull-out guides.

17. The arrangement according to claim 7, wherein the synchronization rod is aligned perpendicular to the opening- and closing direction.

18. An item of furniture comprising:

a furniture carcass;

a drawer; and the arrangement according to claim 6.

19. The item of furniture according to claim 18, wherein the fastening region of each of the two pull-out guides in an installation position is arranged horizontally below the underside of the respective drawer rail of each of the at least two pull-out guides.

20. An arrangement comprising:

at least two pull-out guides each including:

a carcass rail configured to be arranged on a side of a furniture carcass, the carcass rail having a vertical side limb to mount the carcass rail to the side of the furniture carcass, a drawer rail configured to be arranged on a drawer, the drawer rail being displaceably supported on the carcass rail in an opening- and closing direction, the drawer rail having an upper side facing towards the drawer and a lower side spaced from the upper side by a side limb, and a bearing device for supporting a synchronization rod of a synchronization device, the bearing device including a fastening region for receiving the synchronization rod, the fastening region being arranged below the underside of the drawer rail, and a drive device configured to drive the drawer, the drive device being arranged between the drawer rail and the vertical side limb of the carcass rail of at least one of the at least two pull-out guides in a horizontal direction, wherein the at least two pull-out guides are configured to be mounted to opposing sides of the furniture carcass.

21. The arrangement according to claim 20, further comprising a synchronization device for synchronizing movements of the drawer rails of the at least two pull-out guides, the synchronization device including a synchronization rod.

22. An arrangement comprising:

at least two pull-out guides each including:

a carcass rail configured to be arranged on a side of a furniture carcass, the carcass rail having a vertical side limb to mount the carcass rail to the side of the furniture carcass, a drawer rail configured to be arranged on a drawer, the drawer rail being displaceably supported on the carcass rail in an opening- and closing direction, the drawer rail having an upper side facing towards the drawer to support the drawer on the upper side thereof, and a lower side spaced from the upper side by a side limb, and a bearing device for supporting a synchronization rod of a synchronization device, the bearing device including a fastening region for receiving the synchronization rod, the fastening region being arranged below the underside of the drawer rail and between the drawer rail and the vertical side limb of the carcass rail in a horizontal direction, and a synchronization rod received by the fastening region of the bearing device of each of the at least two pull-out guides such that the drawer moves above and over the synchronization rod when moved in the opening or closing direction.

* * * * *